US006331200B1

(12) United States Patent
Stettner et al.

(10) Patent No.: US 6,331,200 B1
(45) Date of Patent: Dec. 18, 2001

(54) METHOD FOR PREPARING GOLD OF HIGH PURITY

(75) Inventors: Martin Stettner, Altenstadt; Matthias Grehl, Frankfurt; Horst Meyer, Altenstadt, all of (DE)

(73) Assignee: W. C. Heraeus GmbH & Co. KG, Hanau (DE)

( * ) Notice: Subject to any disclaimer, the term of this patent is extended or adjusted under 35 U.S.C. 154(b) by 0 days.

(21) Appl. No.: 09/595,123

(22) Filed: Jun. 16, 2000

(30) Foreign Application Priority Data

Jun. 18, 1999 (DE) ..... 199 28 028

(51) Int. Cl.[7] ..... C22B 11/00
(52) U.S. Cl. ..... 75/736
(58) Field of Search ..... 75/736

(56) References Cited

FOREIGN PATENT DOCUMENTS 21 54 093 C2 1/1973 (DE) .
0073108 3/1983 (EP) .
5222465 8/1993 (JP) .
9272927 10/1997 (JP) .
2120485 10/1998 (RU) .

OTHER PUBLICATIONS

T.Havlik, et al., "The leaching behavior of tetrahedrite concentrate in nitrate solution", pp. 210–213, dated 1998, No month.

*Primary Examiner*—Roy King
*Assistant Examiner*—Tima McGuthry-Banks
(74) *Attorney, Agent, or Firm*—Norris McLaughlin & Marcus

(57) ABSTRACT

A method is proposed for producing gold of high purity from noble metal solutions containing nitrate, with the following steps:

a) Nitrate destruction in the noble metal solution, b) Addition of a gold ion reducing acid $Fe^{2+}$ solution whose $H^+$ ion concentration amounts to at least 4 mol/l, to the solution prepared in step a), whose $H^+$ ion concentration amounts to at least 4 mol/l.

5 Claims, No Drawings

METHOD FOR PREPARING GOLD OF HIGH PURITY

The invention relates to a method for preparing gold of high purity from noble metal solutions containing nitrate.

In German Publication: T. Havlik et al.: "The leaching behaviour of tetrahedrite concentrate in nitrate solution" in Metall, 52, 1998, 4, pages 210 to 213, it is disclosed that metals can be dissolved especially well out of nitrate solutions by cementation in the presence of iron ions.

In German Patent 21 54 093 a method has been disclosed, among others, for producing a gold powder from particles of a certain size and shape, which is characterized in that a gold salt solution is reduced at a temperature ranging from 20 to 100° C. with a reducing agent, namely 1) hydroquinone or bromine, chlorine or low alkyl substitution products of hydroquinone or mixtures thereof, or 2) oxalic acid, an alkali salt of oxalic acid or mixtures thereof, or 3) combinations of 1) and 2) in the presence of a protective colloid.

It has long been known to obtain high-purity gold by means of sulfur dioxide from noble metal solutions containing nitrate. A disadvantage of these methods is the necessity of redissolving the products several times. The great number of individual process steps thus called for involves a great amount of time and expense.

From what has been stated, the problem arises of at least partially eliminating the problem by means of a novel process. The problem lies especially in devising a method for producing gold of high purity which succeeds with few working steps.

This problem is solved by the invention by a method according to claim 1.

In the method of the invention, in a first step the nitrate in the noble metal solution is destroyed, for example by adding a reducing agent to the heated solution. Then the gold ions are reduced to gold by the addition of an acid $Fe^{2+}$ solution, the concentration of $H^+$ in the $Fe^{2+}$ solution amounting to at least 4 mol/l. The noble metal solution previously produced free of nitrates has an $H^+$ ion concentration of 4 mol/l.

It is especially advantageous if the reduction of step b), i.e., the addition of an acid $Fe^{2+}$ solution is potential-controlled, since in this manner it is relatively easy to detect the end of the reduction and thus a selective process control is possible.

It is furthermore an advantage if the destruction of t he nitrate is performed with formic acid or ascorbic acid, since these substances specifically reduce nitrate to NO, but not gold ions.

The nitrate destruction is advantageously performed at a temperature of T=+80° C. to +90° C. in order thus to assure an efficient destruction of the nitrate.

Lastly, the solution produced in step a), i.e., the noble metal solution made nitrate-free, is heated before adding the $Fe^{2+}$ ion solution to a temperature of T=+60° C., since in this manner the gold is more fine-grained and has fewer inclusions.

The following example will serve to explain the invention.

Chemicals Used:

Gold solution in aqua regia c(Au)=33.508 g/l, c(Pd)=9.861 g/l, c(Pt)=10.612 g/l

Iron(II) sulfate, techn. $FeSO_4.7\ H_2O$ dissolved in 10 n HCl.

Hydrochloric acid, techn., 10 n

Formic acid, techn., 85%

Nitrate Destruction

In a heated one-liter laboratory reactor with reflux condenser and glass stirrer, 500 ml of the gold-containing starting solution was placed and 285 ml of concentrated hydrochloric acid was added in order to establish an acid normality of 4 mol/l. Then the solution is heated with stirring to a temperature of 100° C. and the temperature is maintained during the addition of the formic acid. Then by means of a peristaltic pump 45 mil of formic acid is pumped in over a period of 1 hour. During the addition of the formic acid, intense NOx vapors occurred, which were no longer to be seen at the end of the nitrate destruction. The redox potential fell during the addition of the formic acid from an initial potential of 854 mV vs. Pt//Ag/AgCl to an end value of 723 mV vs Pt//Ag/AgCl. The solution was cooled at the end to room temperature.

Gold Reduction

After the nitrate destruction the solution was transferred to a glass beaker, and it was observed that a small amount of gold had already precipitated. The residue was put into the beaker complete with the solution. The result was a solution volume of 1500 ml. Then it was heated on the magnetic stirrer to 60° C. and over a period of 2 hours 495 ml of 0.5 n $FeSO_4$ was pumped in with a peristaltic pump. The redox potential decreased during the reduction from an initial value of 723 mV vs. Pt//Ag/AgCl to an end value of 560 mV vs. Pt//Ag/AgCl. After the redox potential of 560 mV vs. Pt//Ag/AgCl the addition of iron sulfate was stopped The mixture was cooled to room temperature and the stirrer shut off. The reduced gold adhered in part to the stirrer and to the redox electrode, but most of it was on the bottom of the beaker. The reduced gold sponge was suction filtered and washed with 100 ml of fully desalted water. Fine, leafy gold spangles were obtained. They were dried in the drying oven at 100° C. (weight: 16.74 g) and subjected to x-ray fluorescence for purity analysis. The filtrate and the wash water were combined, mixed, measured (2000 ml) and a standard DCP analysis was ordered.

For the evaluation of the experiment that follows the following reaction equations were taken as a basis:

$$3HCOOH+2HNO_3=3CO_2\uparrow+2NO\uparrow+4H_2O, \text{ or} \quad 1.$$

$$HCOOH+2HNO_3=CO_2\uparrow+NO_2\uparrow+H_2O \quad 2.$$

$$H[AuCl_4]+3FeSO_4=Au\downarrow+FeCl_3+Fe_2(SO_4)_3+HCl \quad 3.$$

In this experiment, 45 ml of 85% formic acid was consumed for 500 ml of starting solution in the nitrate destruction. At the end of the nitrate destruction a small amount of gold had precipitated, but does not need to be kept separate.

The end of the reduction is indicated by a definite potential drop. The end point is set at 560 mV vs. Pt//Ag/AgCl in order to achieve the necessary purity of the gold simultaneously with an optimum yield of gold.

The amount of iron sulfate solution added (495 ml), at 0.5 mol/l, corresponds according to equation (3) to a theoretical amount of 16.25 g of gold. In the experiment, 16.74 g of gold was reduced out, so that the amount of iron sulfate actually needed corresponds to about 97% of stoichiometry.

The residual gold in the mother liquor amounted to 7 ppm or 0.08% of the gold that went into it. The purity of the gold sponge produces satisfies the criteria of 99.99% fine gold according to the American Standard. The following were found as impurities by GDL analysis:

| | | | |
|---|---|---|---|
| Ag | 11 ppm | Cu | 1 ppm |
| Pt | <3 ppm | Fe | 12 ppm |
| Pd | 25 ppm | Mg | <2 ppm |
| Rh | <1 ppm | Mn | <1 ppm |
| Ru | <1 ppm | Ni | <1 ppm |
| Al | <1 ppm | Pb | <3 ppm |
| Be | <1 ppm | Sb | <5 ppm |
| Bi | <5 ppm | Si | 15 ppm |
| Ca | <1 ppm | Sn | <5 ppm |
| Cd | <5 ppm | Te | <5 ppm |
| Co | <3 ppm | Zn | 2 ppm |
| Cr | 1 ppm | | |

Total: 67 ppm corresponding to more than 99.99% gold purity

What is claimed is:

1. Method for producing gold of high purity from gold-containing noble metal solutions containing nitrate, by the following steps:

a) Destroying the nitrate in the noble metal solution, and b) Adding a gold-reducing acid $Fe^{2+}$ solution having a $H^+$ ion concentration of at least 4 mol/l, to the solution prepared in step a).

2. Method according to claim 1, wherein the reduction of step b) is performed with potential control.

3. Method according to claim 1, wherein the nitrate destruction is performed with formic acid or ascorbic acid.

4. Method according to claim 1, wherein the nitrate destruction is performed at a temperature of T=+80 to +90° C.

5. Method according to claim 1, wherein the solution prepared in step a) is heated before addition of the $Fe^{2+}$ solution to a temperature of T=+60° C.

* * * * *